United States Patent [19]

Brown

[11] 4,015,744

[45] Apr. 5, 1977

[54] EASY-OPEN ECOLOGY END

[75] Inventor: Omar L. Brown, Dayton, Ohio

[73] Assignee: Ermal C. Fraze, Dayton, Ohio

[22] Filed: Mar. 24, 1976

[21] Appl. No.: 670,084

Related U.S. Application Data

[63] Continuation of Ser. No. 625,820, Oct. 28, 1975, abandoned.

[52] U.S. Cl. ..... 220/269

[51] Int. Cl.[2] ..... B65D 41/32

[58] Field of Search ..... 220/265–273

[56] References Cited

UNITED STATES PATENTS

| | | | |
|---|---|---|---|
| 3,836,038 | 9/1974 | Cudzik | 220/269 |
| 3,880,318 | 4/1975 | Fraze | 220/273 |
| 3,967,752 | 7/1976 | Cudzik | 220/269 |

*Primary Examiner*—George T. Hall
*Attorney, Agent, or Firm*—George F. Smyth

[57] ABSTRACT

An improved easy-opening end structure for use with a container includes a retained tab and a captured panel which is also retained. The end structure includes a scoreline of defining a pour opening formed by fracture of the scoreline to release a downwardly dished panel formed by the scoreline. The tab is affixed to the end, other than to the dished panel and includes an opening end positioned over a bead on the panel, and a lifting end spaced from the panel. As the lifting end is raised, the portion of the scoreline between the opening end of the tab and the attachment is popped and thereafter the opening end bears against the panel as the tab is raised further to complete progressive rupture of the scoreline by essentially a class 1 lever action and to push the panel downwardly and laterally through the formed opening. The panel may be hinged or fall free into the container.

24 Claims, 11 Drawing Figures

29
43
28
25
75
44
12
80
35
83
91
50
51
27
95
45
30
16
17
15

29
43
28
25
44
12
80
35
83
91
50
51
27
75
95
45
30
16
17
15

91
93
75
12
15
95
17
80
16

91
93
75
12
112
113
15
115
80
16

29
28
43
25
15
29
28
25
75
30
12
80
35
83
91
50
51
27
45
44
95
30
16
115

EASY-OPEN ECOLOGY END

This is a continuation of application Ser. No. 625,820, filed Oct. 28, 1975, now abandoned.

BACKGROUND OF THE INVENTION

This invention relates to an easy-opening container end wall, and more specifically to an improved easy-opening end wall having a retained tab member operative to form an opening in the end wall by rupture of a tear opening such that the ruptured tear portion also remains with the container.

This application describes an easy-opening end structure which is an improvement over the end structure described and claimed in United States application Ser. No. 608,044, filed on Aug. 27, 1975, and assigned to the same assignee.

The ready acceptance of easy-opening containers has resulted in extended use of this type container for a substantial number of canned products, especially beverages, such as beer, soft drinks, and the like. This type of container, in the form of a can, is characterized by a lever or tab permanently joined to a tear strip, the latter being separable from the can top to provide a pouring spout. In the form heretofore used, the tab or top is ruptured along a continuous scoreline and the pull tab and tear strip are removed as a unit and normally discarded.

The convenience of easy-opening cans has created problems because of the unfortunate and indiscriminate disposal the of the severed portion of the can top. For example, beach and picnic areas have an accumulation of litter in the form of tabs and tear strips which have been removed from easy-opening cans. These discarded tabs and tear strips are quite difficult to clean up because they are small and thus pass through the tines of a rake. Being made normally of aluminum, they cannot be collected by magnetic means. Nonetheless, this type of can is widely used and it is definitely advantageous to provide a solution to the problem of littering while still providing to the public the convenience of the easy-opening cans.

The numerous advantages incident to the use of easy-opening cans has given rise to an industry which has developed to the point where standard procedures and equipment are now in widespread use. For example, many of the machines now used to form the end wall of a container include five stations in which various operations are performed to provide an end unit for a container. By way of example, the first station usually forms the "bubble," transformed into a button in the second station, followed by scoring and forming the rupturable container opening in the third station. In the fourth station any embossing of logo or other information in the container end is carried out, and in the fifth station the tab is attached, i.e., staked to the end unit.

Those in the industry are aware of the need to provide convenience containers of the easy-opening type which overcome the problems of indiscriminate disposal of tabs and tear strips from an ecological standpoint. The provision of a solution to this problem, is somewhat complicated by the fact that whatever end is designed, it is desired that the end be one capable of being made on machines presently in use and which can be modified by changes of tooling in each of the stations generally used in the formation of the end wall without the need to add additional stations. If, for example, an end is designed which requires more than five separate operations, there are practical problems in bringing such an end into commerce because of the need to replace or to rebuild substantially the presently existing equipment in order to add one or more stations. Thus, any structure of an end wall which can be considered an ecology end from the standpoint of having some form of retained tab or tear strip or both and which can be made on currently existing machines with modified tooling at each of the currently existing stations has definite advantages.

Moreover, it is fairly recognized at present that standards have been established with respect to the length and diameter of the component parts and the gauge of materials used in the packaging industry, particularly the soft drink and beverage industry. Thus, in the design of a container end wall intended to form an easy opening end wall for use in the beer and beverage industry, it is desirable to maintain the dimensions of any new structure fairly within the dimensions currently in use in those respective industries.

One of the difficulties which arises in the provision of an end having substantial improvements from the standpoint of ecology is the mode of opening of the end wall. For example, the user has been accustomed to lifting the end of the tab in order to effect rupture of the tear strip. Thus, with certain type of end wall structures presently being marketed and which include push button panels, some user confusion has existed because the structure of the end wall does not include the tab. While the structure just described is intended to be opened by pushing down on the scored button to rupture the same, some users are confused by the absence of any tab or lever.

Another aspect in the provision of an easy-going end structure which has ecological advantages is the variety of products present in the container with which the end wall is to be used. By way of example, it is known that the internal pressure in the container may vary depending upon the type of product within the container as well as the processing during packaging. For example, some beverages are packaged under considerable pressure, in some cases as much as 50 to 80 psi while other products are packaged at a somewhat lesser pressure. The packaged completed container must then be capable of withstanding substantial pressures as might be generated if the container is exposed to direct sunlight which tends to increase the internal pressure within the container. For example in some operations, the can is sealed and pasteurized resulting in the generation of internal pressure within the can.

Thus, it is definitely advantageous to be able to provide a container end structure which has wide applicability insofar as the various conditions involved in packaging the product within the container. Thus, the usual procedure is to attempt to provide a container end wall capable of withstanding the most rigorous conditions required by the industry such that a single design of end may be used over a wide variety of products. Moreover, there is the added requirement that the end structure be capable of manufacture at the usual high rates currently employed by the container industry with the equipment presently used, subject to the change of tooling necessary to adapt the presently existing multiple station machines in order to produce any new and improved end.

In summary, there are constraints within which the industry operates both from the standpoint of the standards which have been adopted, the cost of changeover and the desire to provide an end structure which is satisfactory from the standpoint of reducing the litter which has accumulated by virtue of separable tabs and tear strips.

DESCRIPTION OF THE PRIOR ART

One approach in solving the ecology problems has been to provide a container end structure with a retained tab and tear strip, as for example in U.S. Pat. No. 3,757,989 of Sept. 11, 1973. In that structure, the tab is attached to the tear strip and the tear strip is retained on the end structure subsequent to rupture of the scoreline.

Another approach is described in U.S. Pat. No. 3,795,342 of Mar. 5, 1974, in which the tab is retained with the end structure and folded in a stowing location subsequent to rupture of the tear strip.

There is still another approach to the problem as described in U.S. Pat. No. 3,446,389, of May 27, 1969, in which a tab is attached to the end wall of the container such that the nose thereof overlies a rupturable panel. Upon lifting of the free end of the tab, the nose ruptures a scoreline which is aligned with the center line of the nose and the rivet so as to form two panel sections which are forced downwardly into the container and out of the way. The tab is then pushed back against the end wall.

U.S. Pat. No. 3,826,401 of July 30, 1974, shows an opening member in the form of a lever which is operative to rupture a scoreline lateraly disposed with respect to the rivet, the lever being permanently attached to the end wal.

U.S. Pat. No. 3,853,242 of Dec. 10, 1974, describes a lever member affixed to the end wall in which the lever member includes a panel piercing portion and a finger grasping portion. The lever is rotatable in a plane normal to the panel to rupture a weakening line.

U.S. Pat. No. 3,807,597 of Apr. 30, 1974, describes an end structure for a container including an opening member which is moveable from a non-use position into alignment with a scored section.

Push button panel type container end walls are known in which the removable panel is manually pushed into the container, see for example U.S. Pat. No. 3,886,881 of June 3, 1975.

In the main, however, most easy-open containers include an end structure which is the tear strip severed by manipulation of the tab to form a pour opening. In this type of container, shown for example in U.S. Pat. No. 3,723,744 of Sept. 20, 1966, the tab acts as a class 2 lever in its opening section, the rivet being in the tear out panel while the portion of the scoreline initially ruptured is between the lifting end of the tab and the rivet.

Also known in the art are end structures in which the tab operates as a class 1 lever, i.e. the rivet is between the lifting end and the scoreline and the nose of the tab operates to rupture the scoreline, as for example in U.S. Pat. No. 3,446,389 supra.

A class 2 lever tab effects rupture basically by a lifting action, definitely an advantage where the packaged goods are under pressure since the opening action does not oppose the internal container pressure. In the prior art class 2 lever tabs, the front end of the tab bears against the end wall other than in the pour opening defined by the scoreline. In a class 1 lever type tab, the opening action is downward, and, if the container is under pressure, there is a tendency for the internal pressure of the container to act in opposition to the opening action.

One of the structures being considered from the ecology point of view uses a lanced tab, for example as shown in U.S. Pat. No. 3,406,867 of Oct. 22, 1968, affixed by a rivet to an end wall. The forward nose of the tab overlies a circular raised bead located in the general central area of a scored section which forms the pour opening. The score line is non-circular in shape and the tab is affixed in the center of the end structure, generally along the center line of the end with the pour opening adjacent to the chuck wall and in line with the tab.

United States application Ser. No. 608,044, above identified, represents another approach to the problem and the end structure therein described are a substantial improvement over prior devices for the reasons therein described. The present invention represents an improved end structure over those described in that application.

SUMMARY OF THE INVENTION

The end structure of the present invention differs from the prior art and the structures above described in that the tab is substantially improved and cooperates with a pour panel for relatively simple and efficient operation. Several significant functional and practical advantages are provided in addition to an ecology type of end.

The improved end structure of this invention includes an end wall having a scoreline which defines an opening panel. Although the scoreline could be continuous, it is preferably discontinuous to form a hinged panel. Attached to the end wall by a rivet or suitable means and in a location other than on the panel but on the center line of the end wall, is a tab whose opening end overlies the panel and whose lifting end is spaced away from the panel. Thus, the tab remains fixed to the end wall and is not separable upon rupture of the opening.

The scoreline includes a portion located between the rivet and the opening end of the tab, the latter overlying the panel. The tab is in the form of a substantially longitudinally rigid lever which is operative upon lifting one end thereof to initiate rupture of the portion of the scoreline between the opening end and the rivet, the initial pop, so called by a shearing action. Further lifting of the tab will effect progressive rupture of the scoreline. Thereafter, the panel may be pushed in manually or the tab may be raised further to force the panel laterally and downwardly. Whether done manually or by the tab, the resullt is a ruptured panel which may be hinged or which may free fall into the container like some of the push button ends known in the art.

In a preferred form of this invention, the dished pour panel includes a raised button forward of the rivet and the scoreline and located beneath the opening end of the tab. Surrounding the rivet is a rivet well formed in the rivet forming sequence, the scoreline being located so that a protion thereof is in the rivet well forward of the rivet and constitutes that portion of the scoreline which is initially popped. The raised button includes an end portion located in the rivet well, forward of that portion of the scoreline and in general alignment with the rivet although the forward portion is angularly oriented to the right as seen from the front of the tab.

While the end structure of this invention may take various forms, an improved tab structure is used which is retained with the end wall, and includes a relatively rigid body member having a lifting end and an opening end with a flap member between the lifting and opening end. The flap member receives an attaching member, preferably in the form of a rivet, and retains the tab on the end wall subsequent to completion of severance of the scoreline by the opening end which preferably includes at least one finger disposed forward of the flap member.

The tab itself is of sheet material such as tin plate or aluminum sheet and the finger at the opening end includes a forward finger portion and a rearward finger portion positioned slightly below the forward portion.

In an opening sequence, the finger contacts the raised button to apply a downward pressure on the pour panel while the flap lifts upwardly on the rivet thus stressing the portion of the scoreline between the rivet and the bead, i.e. that portion in the rivet well. The stress is a shear type of stress resulting from a combined class 2 and class 1 lever action of the tab during the initial pop phase of an opening sequence. Where the container is under pressure, the pressure cooperates with the class 2 lever action of the tab to initiate the pop by a lifting action on the rivet.

Subsequent to the pop, the tab acts as a class 1 lever to rupture the scoreline progressively in a counterclockwise direction, i.e. from the rivet in a counterclockwise direction aong the scoreline towards the hinge. This progressive type of scoreline rupture has the advantage of a smooth opening action.

Subsequent to rupture, the tab may be raised further to fold the hinged panel beneath the end wall while the tab may then be pushed flat against the end wall, out of the user's way.

In addition to improved operation, the end of this invention is more compact in that the tab does not extend vertically above the top flange while the dished pour panel does not, in the unopened condition, extend below the groove between the chuck wall and center panel.

It will be apparent from the following detailed description that a much improved retained tab and tear strip end structure is disclosed, and the further features and advantages thereof may be best understood by reference to the following description taken in connection with the accompanying drawings.

DETAILED DESCRIPTION OF THE INVENTION

Figure 1:
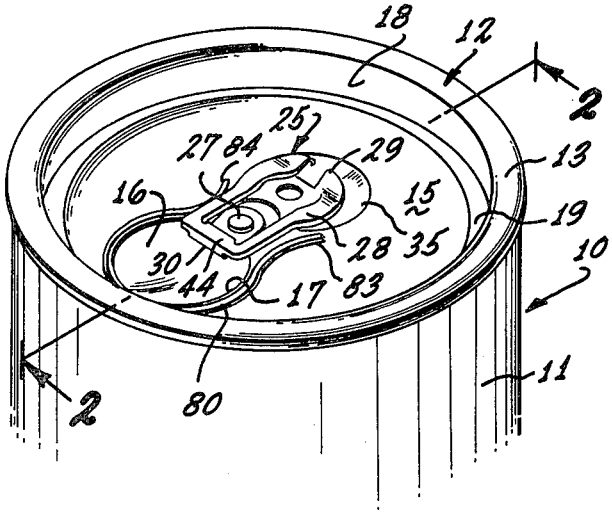
FIG. 1 is a view in perspective of the end structure of the present invention attached to a container shown fragmentally.

Referring to the drawings which illustrate a preferred form of the invention, FIG. 1 shows a container 10 including a side wall 11 having an end closure 12 attached thereto in the usual manner through a peripheral flange 13 on the closure member.

The end structure 12 is formed of sheet material, such as aluminum alloy and the like, and includes a central wall or panel portion 15 having a pour panel 16 therein, the pour panel being downwardly dished and at least partially circumscribed by a scoreline 17 which is ruptured to form a pour opening in the end structure.

Figure 2:
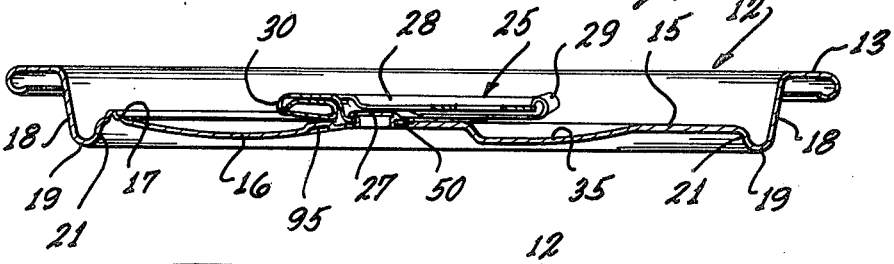
FIG. 2 is an enlarged view, partly in section and partly in elevation, taken along the line 2—2 of FIG. 1.

As seen in FIG. 2, the end wall 12 of the container includes a chuck wall 18 which terminates in the flange 13 which is vertically above the central panel 15 while a groove 19 is at the base of the chuck wall, the groove being positioned vertically below the center panel 15. An intermediate wall 21 connects the groove 19 to the center panel 15.

As illustrated, the pour panel 16 is adjacent to the intermediate wall 21 and close to the chuck wall 18 and located generally on the center line of the end wall 12. If desired, the pour panel may be offset as described in Ser. No. 608,044.

Referring now to FIGS. 1 and 2, the easy-opening end structure 12 includes a tab 25 affixed to the central wall 15, as opposed to the panel 16, by an integral rivet 27, each on the same center line with the panel 16, as illustrated. The tab includes a longitudinally rigid body member 28 having a lifting end generally designated 29 and and opening end generally designated 30. The central wall also includes a finger well 35 positioned therein essentially below the lifting end 29 of the tab 25. In this way, the user may conveniently insert a finger underneath the lifting end of the tab during an opening sequence to be described below.

Figure 3:
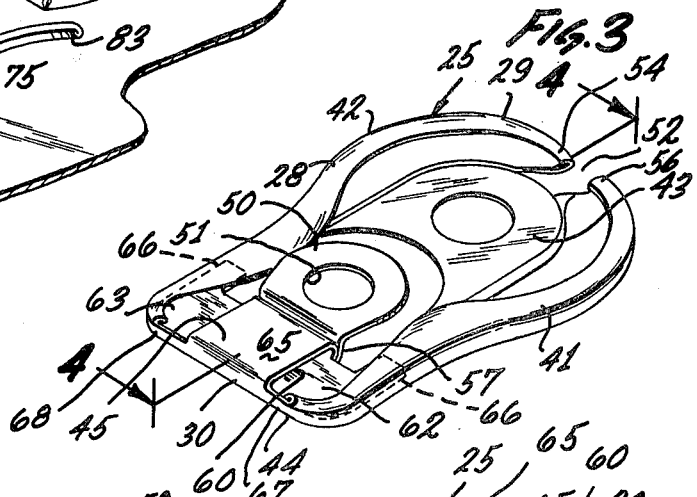
FIG. 3 is a view in perspective of the underside of the tab in accordance with this invention.
Figure 4:
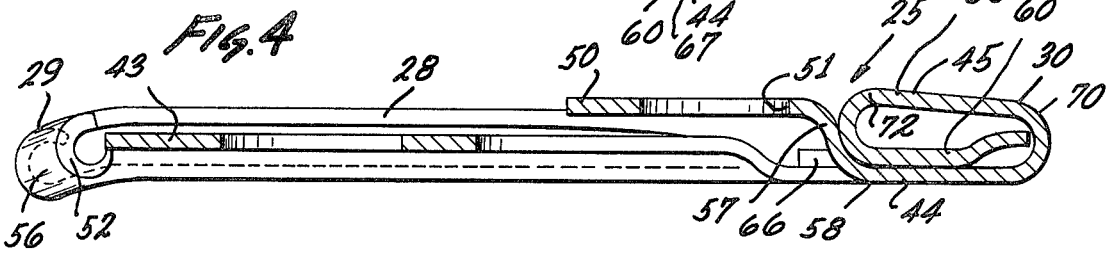
FIG. 4 is an enlarged view, partly in section and partly in elevation of the tab taken along the line 4—4 of FIG. 3.

More specifically as shown in FIGS. 3 and 4, the tab includes two longitudinally extending legs 41 and 42 interconnected, at the rearward end of the tab by a web of material generally designated 43 and at the forward end by a cross-member 44 from which a finger 45 depends.

To the rear of the opening end of the tab is a flap member 50 extending rearwardly from the cross-member 44 towards the lifting end. The flap 50 which constitutes an extension of the cross-member 44 forms a separate narrow web of material having an aperture 51 through which the rivet 27 passes to secure the tab in place on the central wall 15. The side walls of the flap are spaced from the inner surfaces of the legs 42 and 41, and also is spaced from the web 43 and the tab functions as a longitudinally rigid lever.

The improved tab of the present invention is preferably formed of sheet material, such as tin plate or aluminum and forms a longitudinally rigid structure so as to function properly in the opening sequence. The legs 41 and 42 are curled for safety and for strength and are interconnected at their one end by the flap portion 43 which is depressed downwardly and which forms a bridging web between the upper surface of each leg. The lifting end of the tab includes a notch 52 resulting from severance of a web used to hold the tab during its formation by a progressive set of tools, as is well known. The ends 54 and 56 are curled and radiused to prevent contact with the residual metal in the notch.

At the opening end, the cross-member 44 interconnects the legs, the cross-member being integral with the flap through a curved intermediate portion 57. The opening end of the tab is formed of multiple layers of sheet metal for strength purposes, one layer constituting the face 58 of the crossmember from which finger 45 is formed, the latter being bent back under to provide a T-layer 60 having spaced ears 62 and 63 received between the curl of each of the legs 41 and 42. The third layer is formed by finger layer 65. Each ear 62 and 63 includes an axially extending end 66 also received under the curl and providing some strength at the forward end of the tab in a direction axially of the tab. As illustrated in FIG. 3, the forward end of the tab on each side of the finger includes downwardly depending skirts 67 and 68 integral with the face 58.

The finger 45 is thus centrally located at the front end of the tab and includes a forward finger portion 70 and a rearward finger portion 72, the latter extending downwardly relative to the front portion 70 and projecting downwardly slightly below the flap 50. Overall, the tab is wider in a transverse direction at the rear portion thereof, as illustrated. Also, the rear or lifting end of the tab is bent upwardly to facilitate manipulation and the end curls are compressed to reduce vertical height. The tab is quite compact being approximately 0.900 inches in length, 0.624 inches in the largest transverse dimension and being approximately 0.078 inches in maximum cross section. By way of example, the tab may be of tin plate of 0.014 inches thickness. As seen in FIG. 2, the tab rests well below the flange 13.

Figure 5:
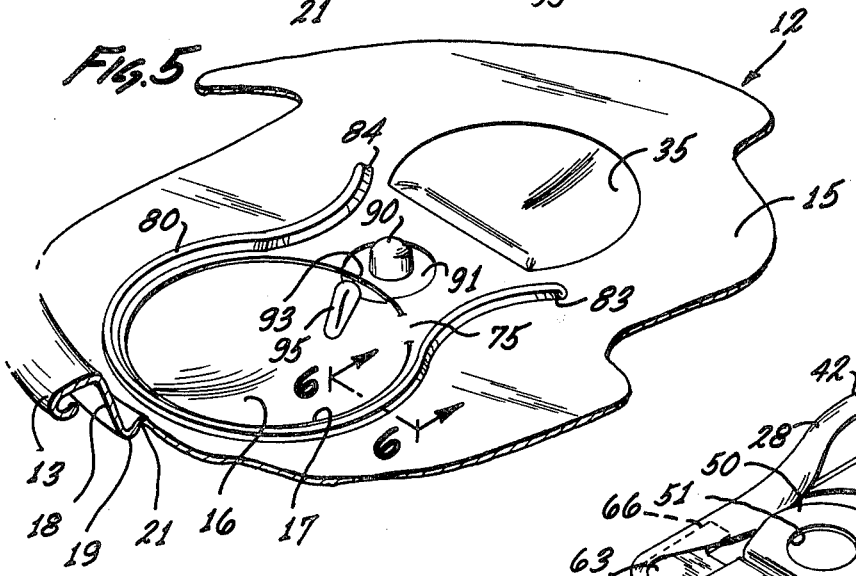
FIG. 5 is an enlarged view in perspective, with portions broken away and the tab removed showing the rivet before staking off an end structure of this invention.

Referring to FIG. 5, located laterally of the center line of the tab is a hinge 75 which retains the panel 16 on the central wall subsequent to rupture of the scoreline 17. The scoreline may be continuous in which event the severed panel may fall into the container and remain there.

The scoreline 17, may be of a variety of types, and in the form of the invention described, is of the pinched score variety. The scoreline 17 extends substantially completely around the panel except for the section 75 which is unscored and which forms a hinge. A continuous scoreline may be used in which event, the severed panel 16 falls into the container and remains there. The scoreline in the portion of the central wall 15 adjacent to the rivet is located in a rivet well and underneath the rivet head which overlies the flap 50, as will be described. Thus, the scoreline is close to the vertical wall forming the upstanding rivet.

Figure 6:
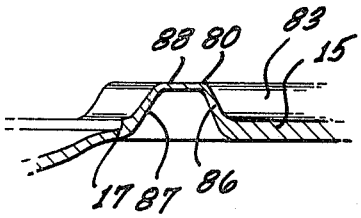
FIG. 6 is an enlarged view partly in section and partly in elevation taken along the line 6—6 of FIG. 5.

Cooperating with the scoreline 17 is a bead 80 which surrounds a substantial portion of the scoreline and which includes curved legs 83 and 84 which terminate near but spaced from the finger well 35 as shown in FIG. 5. As seen in FIG. 6, the bead includes side walls 86 and 87 and a top wall 88 which is essentially flat, the top wall being thinner than the side walls. The bead operates to absorb tension stresses as pressure tends to expand the end structure. Thus, rather than cracking, the bead absorbs the stresses and protects that portion of the end wall between the arms of the bead from cracking. The portion of the bead adjacent to the scoreline offers some protection to the scoreline from pressure tending to dome the end structure. As shown, the bead 80 is closely adjacent the intermediate wall 21 and also serves to provide some protection against the edge which remains after rupture of the scoreline, as will be described.

Surrounding the rivet, shown in button form 90 is a rivet well 91 in which the metal of the central wall in that portion surrounding the rivet has been coined and reduced in thickness through the application of a compressive force during rivet forming operations, a sequence well known in the art. It will be seen that a portion 93 of the scoreline 17 is closely adjacent to the vertical wall of the rivet and in the rivet well. It is this portion of the scoreline which initially pops during the opening sequence. Forward of the rivet and located in the panel 16 is a button or bead 95 which is raised upwardly and which is located beneath the opening end 30 of the tab 25.

As seen in FIG. 5, the rear portion of the bead 95 overlies a portion of the rivet well 91 and is spaced a slightly greater distance from the scoreline portion 93 than the scoreline is from the rivet. The bead 95 is positioned in an angular relation, i.e. oriented such that the rear portion is in alignment with the rivet and the forward portion angled toward the hinge 75. With the tab on the end, substantially the entire portion of the bead is beneath the tab with the rear portion 72 of the finger overlying the bead but spaced a small distance vertically above the bead to provide some idle lift which facilitates initial lifting of the tab and at the start of an opening sequence.

At the start of an opening sequence, the user inserts a finger between the lifting end 29 of the tab 25 and the finger well 35 to urge the lifting end of the tab upwardly. The initial upward movement of the lifting end results in the finger of the tab bearing firmly against the panel 16 by contacting the bead 95. The finger on the opening end of the tab is substantially displaced forward of that portion of the scoreline located in the rivet well. Thus, the lifting motion of the end 29 of the tab results in a lifting movement of the rivet through the action of the flap to pull that portion of the central wall surrounding the rivet in a generally upward direction while the finger bears downwardly against the panel 16. Thus, the panel is subjected to a downward force while the rivet is lifted. This shearing action effects the initial pop of the portion 93 of the scoreline forward of the rivet and in the rivet well and the initial pop is the result essentially of a lifting action.

In the case of beer and beverage containers, an opening operation by which the scoreline is initially ruptured by an upward movement offers the advantage of not having to work against the pressure, if any, which is in the interior of the container. Where the container is under pressure, the downwardly dished panel tends to result in the scoreline being in compression and also opposes the downward force of the opening end of the tab.

After the initial pop, the tab then acts as a class 1 lever and the finger bears against the bead on the panel to urge the latter downwardly to effect fracture of the remainder of the scoreline, although it is understood that one may manually rupture the remainder of the scoreline by using a finger. It is preferred, however, that the tab be used which is merely lifted towards the vertical position. After fracture of the scoreline, the tab is pushed back to its original position.

Figure 7:
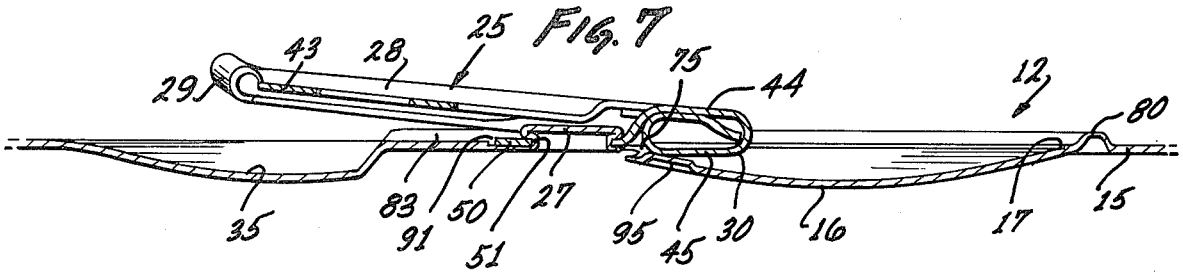
FIG. 7 is an enlarged fragmentary view, partly in section and partly in elevation, showing the relative position of the parts during the initial pop phase of an opening sequence.

Referring now to FIG. 7, the relative position of the parts is illustrated at the start of an opening sequence. The finger 45 initially is spaced a small distance from the button so that some idle lift is provided at the start of an opening sequence. The panel 16 is downwardly dished while the button is raised above the dished portion but still below the level of the remainder of the end wall.

In the relative position of the parts illustrated in FIG. 7, the scoreline has been initially popped, that is, initially fractured in the area of the scoreline in the immediate vicinity designated 93 in the confines of the coined area of the rivet well. It will also be observed that the initial pop is of that portion of the scoreline in the rivet well and forward (to the right as seen in FIG. 7) of the rivet and is operative to release any pressure within the container. Thus the initially fractured segment of the scoreline is beneath the flap 50 and, to some extent, this relative arrangement operates to shield the user from direct exposure to any spray which might emanate from a container under pressure.

Figure 8:
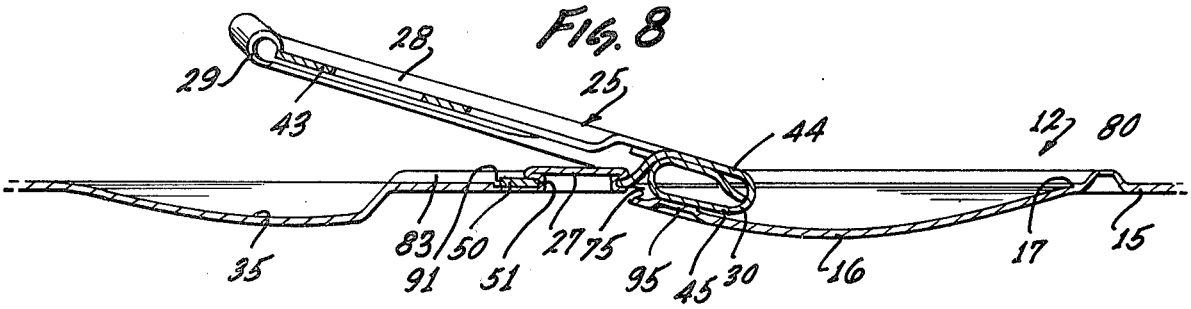
FIG. 8 is a view similar to FIG. 7 illustrating the relative position of the parts during progressive rupture of the scoreline, in accordance with this invention.
Figure 9:
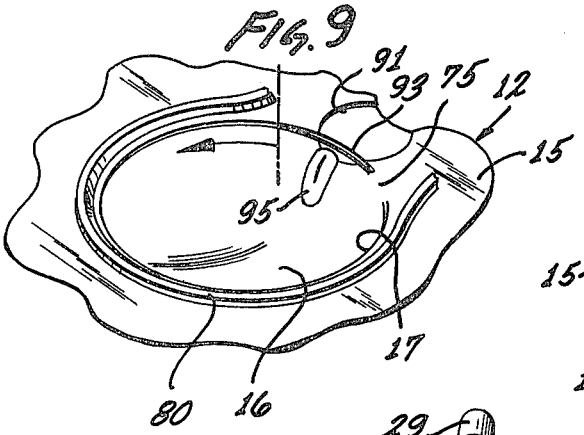
FIG. 9 is a view in perspective, with the tab removed, illustrating the direction of progressive rupture of the scoreline.

Referring now to FIGS. 8 and 9, subsequent to the initial pop of the scoreline as illustrated in FIG. 7, continued lifting movement of the tab in the direction indicated by the arrows in FIG. 8 results in a class 1 lever type of opening action since the lever is pivoted around the rivet which now acts as a fulcrum causing the forward opening end on which the finger is present to move downwardly in the direction indicated by the arrow. In this type of opening operation, the flap 50 and the web portion 57 act as a hinge to permit the opening end of the tab to move downward in response to raising of the lifting end. The next sequence in the opening operation involves continued fracture of the scoreline about a substantial portion of its periphery.

As seen in FIG. 9, continued fracture of the scoreline after the initial pop proceeds in a progressive fashion in a counterclockwise direction. Thus, after the initial pop which ruptures portion 93, the fracture of the scoreline progressively moves in the direction of the arrow by virtue of the opening end of the tab, more particularly the finger bearing on the bead 95. Since the hinge 75 is to the right of the rivet, a downward force on the panel shears the scoreline until the scoreline ruptures from portion 93 counterclockwise to hinge 75. This type of scoreline rupture is smooth and effective even though the tab has not been lifted substantially by the relative position illustrated in FIG. 8.

At this point, or after the initial pop, the user has two options available for completing the opening sequence. Either the free end of the tab may be lifted, a preferred mode of operation, or the user may use a finger to push the panel 16 downwardly since a considerable portion of the scoreline has been ruptured. Tests indicated that in the relative position of the lifting end indicated in FIG. 8 very little lifting of the free end of the tab has resulted in the initial pop and a progressive fracture of a substantial portion of the scoreline. Tests of the structure indicate that in the relative position shown in FIG. 8, the scoreline is ruptured to about 90 percent of its periphery.

As will be seen from FIG. 1, the front of the tab is in chordal relation with the panel 16 which is hinged at 75 on one side of the center line through the rivet 27 and the bead 95. The bead 95 insures that the force applied by the opening end of the tab is centrally located on the panel and further from the scoreline and hinge to increase the advantage of the lever action subsequent to the initial pop.

Figure 10:
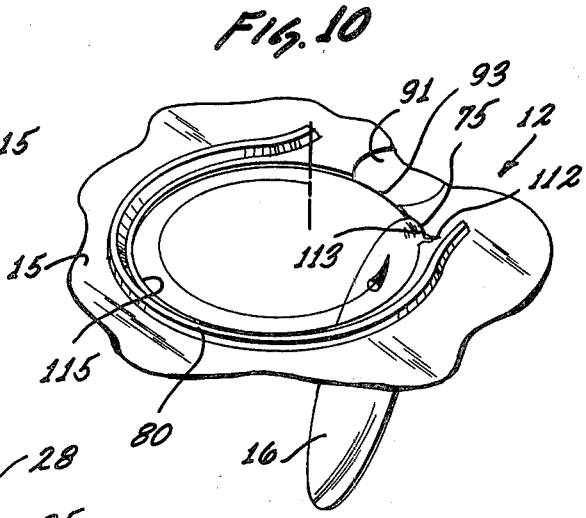
FIG. 10 is a view in perspective, with the tab removed, illustrating the position of the panel beneath the end wall.

If the user manually depresses the panel 16 by pushing down on it with a finger, the panel hinges about hinge 75 located laterally to the side of center axis of the tab and folds underneath the end wall and out of the way of the opening formed by rupture of the scoreline. The hinge operates to retain the severed panel to the end wall, with the panel being located out of the opening. It will be apparent, therefore, that one may optionally eliminate the hinge so that the panel is free to fall within the container. Because of the geometry, thepanel is not capable of coming out of the opening once it has been pushed to the side as shown in FIG. 10 in the case of a hinged panel or pushed into the container in the case of a free panel. Thus, the panel remains with the container after the opening. Likewise, the tab remains with the end since the tab is affixed to the central wall portion as opposed to the severed panel. Thus, there is no separate tab and tear strip combination, or a separate free tab, or a separate free panel, potentially capable of causing litter.

Figure 11:
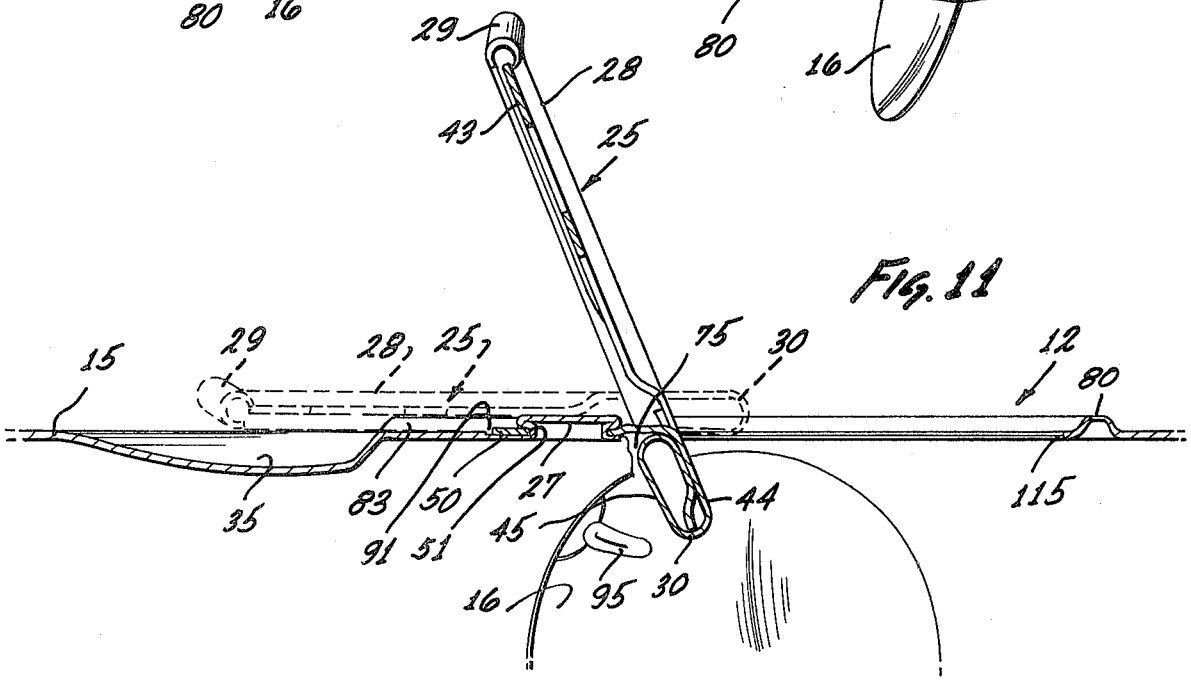
FIG. 11 is a view partly in section and partly in elevation showing the relative position of the tab near the completion of an opening sequence, in accordance with this invention.

At the user's option, the lifting end of the tab may be raised further to the relative position illustrated in FIG. 11. In the transition of tab position from that shown in FIGS. 7 and 8 to that shown in FIG. 11, the finger 45 is operative to bear against the upper surface of the panel to urge the same downwardly and lateraly to the side as shown in FIGS. 10 and 11. Initially, the finger contacts the bead for the purpose of rupturing a substantial portion of the scoreline, but as the end of the tab is lifted from the position shown in FIG. 8 to the position shown in FIG. 11, finger 45 is principally operative to urge the panel downwardly and laterally. As illustrated, the panel has been urged downwardly and laterally about the hinge 75. Since the front of the tab is in a chordal relation, as the panel 16 moves downwardly, the finger cams over the bead 95 and for this reason the finger is formed with a rear portion which extends downwardly a distance greater than the forward portion. Thus, the bead remains under the finger until the panel is folded out of the opening. It is for this reason that the hinge 95, if used, is set to one side or the other of the center line of the tab as illustrated in FIG. 5. With the free end of the tab between 45° and 90°, or at approximately 70° as illustrated in FIG. 11, the panel 16 has been pushed back sufficiently such that it essentially clears the pour opening. Continued upward movement of the lifting end of the tab results in the panel being pushed completely back beyond and out of the way of the opening. Following this operation, the tab may be pushed back against the end wall to approximately the dotted line position shown in FIG. 11 where it is out of the user's way.

It is preferred in the practice of the present invention that each of the tab and the panel 16 be retained on the end structure. Accordingly, the web 50 is used to retain the tab while the hinge 75 retains the panel. To prevent the tab from being bent off, it is preferably formed of tin plate. It should be noted that the hinge tears along it side as illustrated at 112. This tearing action assures that the panel remains retained rather than being sharply folded along the hinge.

For example, if the grain of the metal is at right angles to the hinge line 113, a sharp fold along the grain may be sufficient to weaken the retaining hinge since the fold line is parallel to the grain. By providing a rolling fold and some tearing along the hinge, a sharp fold is eliminated, thus assuring retention of the panel even if folded more than once.

In the manufacture of the end structure, five operations are normally used, for example, bubble formation, transformation of the bubble to a button stage, scoreline formation, logo embossing and finally tab staking. In accordance with this invention an improved scoreline is employed of the pinched score variety which offers the advantage that the scoreline may be held in compression provided the panel is dished downwardly sightly as described. Formation of the scoreline is disclosed in application Ser. No. 608,044, which disclosure is incorporated herein by reference.

With the panel out of the way, as seen in FIG. 11, the peripheral bead 80 affords some protection against laceration of the edge 115 of the scoreline. Note that the scoreline fractures close to the vertical wall 120 (FIG. 6) and that wall 87 of the bead 80 is close to the wall 120.

It will be apparent to those skilled in the art that various modifications and alterations may be made, for example, the hinge may be placed on the left of the rivet with a corresponding alteration of the location of the bead 95 such that it performs the same function as already described. Oval type openings may be used rather than circular as shown. In the form illustrated, the container pours well and the end may be easily formed with appropriate tooling in a five station press from end blanks of standard dimension.

Various modifications may be made, as will be apparent from the above, without departing from the invention as set forth in the appended claims.

I claim:

1. An easy-opening end structure for use with a container comprising:

and end wall of sheet material including a chuck wall terminating in a peripheral flange positioned vertically above a center panel section and a groove located at the base of the chuck wall and extending vertically below said center panel section;

means in said center panel section defining a pour panel at least partially circumscribed by a scoreline to form an opening in said center panel section;

tab means including a lifting end and an opening end;

means to affix said tab means to said center panel section such that the opening end thereof overlies said pour panel whereby said tab remains fixed to said central panel section after formation of said opening;

said scoreline including a portion located between the opening end of said tab and said affixing means and defining a generally circular pour panel;

said tab including spaced side legs interconnected at the forward end by a cross-member including finger means to bear against said panel during an opening sequence, said cross-member of said tab being in chordal relation to said scoreline;

said tab being a longitudinally rigid lever operative in response to raising the lifting end thereof to cause the opening end of the tab to bear against said panel and to lift on said affixing means thereby lifting the portion of center panel surrounding said affixing means to initiate rupture of the portion of the scoreline located between the opening end of the tab and the affixing means by a shearing action; and said tab being operative in response to raising the lifting end thereof to urge said panel downwardly to effect rupture of the remainder of the scoreline.

2. An easy-opening end structure as set forth in claim 1 wherein said tab functions as a class 1 lever subsequent to initiation of rupture of said portion of said scoreline.

3. An easy-opening end structure as set forth in claim 1 wherein said tab is of sheet material and includes an opening end portion having a plurality of layers of sheet material.

4. An easy-opening end structure as set forth in claim 1 wherein said scoreline is discontinuous to form a hinge to retain said panel on said end wall subsequent to rupture of said scoreline.

5. An easy-opening end structure as set forth in claim 1 wherein said tab includes a flap member which forms an extension of the cross-member, said cross-member extending substantially across the width of the opening end of the tab, and said flap member forming an extension of the cross-member and being spaced from said side legs.

6. An easy-opening end structure as set forth in claim 1 wherein said scoreline is discontinuous and forms a hinge connecting said pour panel and said central panel, said hinge being located laterally of said tab; and said opening end of said tab being operative in response to lifting of the lifting end of said tab and rupture of said portion of the scoreline and to urge said pour panel downwardly and beneath said central panel.

7. An easy-opening end structure as set forth in claim 6 wherein the opening end of said tab includes a finger which extends downwardly and bears agains the panel during an opening sequence, and said finger being positioned in alignment with said affixing means and operative in response to lifting of the lifting end of said tab to urge said panel downwardly subsequent to initial rupture of the scoreline.

8. An easy-opening end structure as set forth in claim 1 wherein said panel is downwardly dished and includes hinge means laterally of said tab for retaining said panel subsequent to rupture of said scoreline.

9. An easy-opening end structure as set forth in claim 1 wherein said attaching means is an integral rivet, a rivet well surrounding said rivet;

said portion of said scoreline being located in said rivet well, and said pour panel including a raised bead a portion of which overlies said rivet well to the front of said rivet and forward of said scoreline.

10. An easy-opening end structure as set forth in claim 9 wherein said scoreline is a pinched scoreline.

11. An easy-opening end structure as set forth in claim 9 wherein said opening end of said tab includes finger means bearing against said panel; and said finger including a downwardly extending rearward portion for initial contact with the raised bead on said pour panel.

12. An easy-opening end structure as set forth in claim 11 wherein said downwardly extending finger is in alignment with said rivet.

13. An easy-opening end structure as set forth in claim 12 wherein said tab includes flap means extending rearwardly from said opening end, and said flap means receiving said rivet.

14. An easy-opening end structure as set forth in claim 1 wherein said cross-member defines a relatively broad forward face of said tab.

15. An easy-opening end as set forth in claim 14 wherein said cross-member is formed of multiple folds of sheet material.

16. An easy-opening end structure for use with a container comprising:

an end wall of sheet material;

means cooperating with the end wall for attachment to a container;

means in said end wall defining a panel arranged essentially on a center line of said end all and at least partially circumscribed by a scoreline to form an opening in said end wal;

tab means including a lifting end and an opening end;

rivet means to affix said tab means to said end wall on the center line thereof such that the opening end thereof overlies said panel whereby the tab remains affixed to said end wall after formation of said opening;

said opening end of said tab being composed of multiple folds of sheet material having a relatively broad face;

rivet well means surround said rivet;

bead means located on said panel and spaced from said scoreline;

said scoreline being generally circular in configuration and including a portion located in the rivet well and between the opening end of the tab and said rivet means;

said tab being a longitudinally rigid lever and including spaced side legs, and being operative in response to raising the lifting end thereof to cause the finger means on the opening end of the tab to bear against said panel and to lift on said rivet means and to lift on the portion of said end wall in said rivet well to initiate rupture of the portion of the scoreline located between the opening end of the tab and the affixing means by a shearing action; and said tab being operative as a class one lever in response to raising the lifting end thereof to urge said panel downwardly to effect progressive rupture of the remainder of the scoreline.

17. An easy-opening end structure as set forth in claim 16 wherein said tab includes cross-member means at the opening end thereof interconnecting said side legs, said tab being formed of sheet material, and said cross-member means being formed of at least two plys of sheet material.

18. An easy-opening end structure as set forth in claim 16 wherein said panel includes hinge means laterally positioned with respect to said rivet; and said progressive rupture of the remainder of said scoreline starting opposite said hinge and progressing sequentially and terminating at said hinge.

19. An easy-opening end structure as set forth in claim 18 wherein said hinge means is located beneath the opening end of said tab and forward of said rivet.

20. An easy-opening end structure as set forth in claim 19 wherein said opening end of said tab includes a broad face disposed in chordal relation with said scoreline.

21. An easy-opening end structure for use with a container comprising:

an end wall of sheet material including a chuck wall terminating in a peripheral flange positioned vertically above a center panel section and a groove located at the base of the chuck wall extending vertically below the center panel section, said center panel section including an intermediate wall forming the connection between the groove and the center panel section, means in said center panel section defining a downwardly dished circular panel partially circumscribed by a scoreline to form an opening in said end wall;

tab means including a lifting end and an opening end;

rivet means to affix said tab means to said center panel section such that the opening end thereof overlies said circular panel whereby the tab remains affixed to said center panel section after formation of said opening;

said scoreline including a portion located between the opening end of the tab and said rivet means;

said panel including hinge means retaining said panel to said end wall upon rupture of said scoreline;

means forming a raised bead on said dished panel positioned beneath the opening end of said tab and oriented angularly toward said hinge;

bead means adjacent at least a portion of said scoreline; and including a portion between said intermediate wall section and said dished panel;

said tab being a longitudinally rigid lever operative in response to raising the lifting end thereof to cause the opening end of the tab to bear against the raised bead on said dished panel and to initiate rupture by shearing that portion of the scoreline located between the opening end of the tab and the rivet means; and said tab being operative in response to raising the lifting end thereof to urge said dished panel downwardly to effect rupture of the remainder of the scoreline and to urge said hinged panel through the formed opening.

22. An improved tab of sheet material for use with an easy-opening end structure comprising:

a relatively rigid body member having a lifting end and an opening end spaced from the lifting end;

said body member including spaced leg means;

said leg means being curled under to provide for reinforcement of said legs;

means between said legs and between said lifting and opening end for receiving affixing means to attach said tab to an end structure;

cross-member means interconnecting said spaced legs at the opening end;

finger means projecting downwardly from said cross-member and including a forward and rearward finger portion at said opening end for contacting a portion of the panel in the end to be ruptured; and said finger being centrally located at the opening end thereof and said rear finger portion which extends downwardly relative to said forward finger portion.

23. An improved tab as set forth in claim 22 wherein said cross-member is formed of at least two plys of sheet material.

24. An improved tab as set forth in claim 23 wherein said means to attach said tab to an end structure includes flap means extending from said cross-member towards the opening end of said tab, said flap means being spaced inwardly of said legs, and said flap forming a continuation of the upper portion of said cross-member.

* * * * *